US005362290A

United States Patent [19]

Huang

[11] Patent Number: 5,362,290

[45] Date of Patent: Nov. 8, 1994

[54] MULTI-PURPOSE EXERCISER HAVING A CLUTCH MEANS

[76] Inventor: Shih-Pin Huang, 4th Fl., No. 9, Lane 228, An Kang Rd., Taipei, Taiwan, Prov. of China

[21] Appl. No.: 83,562

[22] Filed: Jun. 30, 1993

[51] Int. Cl.[5] ..... A63B 21/062

[52] U.S. Cl. ..... 482/100; 482/102; 482/137; 482/138; 482/908

[58] Field of Search ..... 482/38–41, 482/97–103, 118, 133–138, 908

[56] References Cited

U.S. PATENT DOCUMENTS

| | | | |
|---|---|---|---|
| 2,632,645 | 3/1953 | Barkschat | 482/38 |
| 2,832,334 | 4/1983 | Whitelaw | 432/118 X |
| 4,316,609 | 2/1982 | Silberman | 482/102 |
| 4,349,192 | 9/1982 | Lambert, Jr. et al. | 482/101 |
| 4,441,706 | 4/1984 | Korzaniewski | 482/38 X |
| 4,505,475 | 3/1985 | Olschansky et al. | 482/100 |
| 4,531,727 | 7/1985 | Pitre | 482/103 X |
| 4,598,908 | 7/1986 | Morgan | 482/97 X |
| 4,619,453 | 10/1986 | Plumridge | 482/102 |
| 4,624,457 | 11/1986 | Silberman et al. | 482/99 X |
| 4,744,560 | 5/1988 | Azari | 482/102 X |
| 4,775,146 | 10/1988 | Stankovic | 482/102 |
| 4,781,374 | 11/1988 | Lederman | 482/103 |
| 4,826,157 | 5/1989 | Fitzpatrick | 482/103 X |
| 4,856,773 | 8/1989 | Deola | 482/102 |
| 5,056,779 | 10/1991 | Webb | 482/100 X |
| 5,092,590 | 3/1992 | Jones | 482/100 |

*Primary Examiner*—Richard J. Apley
*Assistant Examiner*—John Mulcahy
*Attorney, Agent, or Firm*—Omri M. Behr; Matthew J. McDonald

[57] ABSTRACT

An exerciser includes a weighted base, a frame member, a resistance assembly mounted in the frame member, and a lifting bar mechanism. The lifting bar mechanism includes an axle rotatably mounted in the frame member, a gear securely mounted on the axle, a lifting bar connected to the axle to rotate therewith, a clutch seat mounted on the axle surrounding and receiving the gear and having a cutout in a periphery thereof, a rocker arm extending outward from an outer periphery of the clutch seat, a cable having a first end attached to the rocker arm and a second end attached to the resistance assembly, and a clutch assembly with a pawl member for releasably engaging with the gear under the control of a clutch lever thereof. When the clutch lever is pressed, the user may adjust the lowermost position of the lifting bar.

8 Claims, 8 Drawing Sheets

MULTI-PURPOSE EXERCISER HAVING A CLUTCH MEANS

BACKGROUND OF THE INVENTION

The present invention relates to multi-purpose exercisers which allow the user to practice weight lifting, hands and legs pulling, horizontal bar exercise, sit ups, and boxing.

For modern people who do not have much time and space to exercise, exercisers provide an excellent means therefor. A conventional exerciser usually includes a weight lifting means in which the user lies on a mat and pushes a lifting bar connected to a resistance means. The user, however, might be injured if he does not have enough arm strength to slowly put down the lifting bar or the lifting bar does not align with the supporting seat on which it should rest. Another disadvantage of conventional exercisers is that the mat is not foldable and thus occupies a certain space. A further disadvantage of conventional exercisers is that the lifting bar is not adjustable in height. The present invention provides an improved multi-purpose exerciser to mitigate and/or obviate the problems in the conventional exercisers.

SUMMARY OF THE INVENTION

The present invention provides an exerciser which includes a weighted base, a frame member mounted on the weighted base, two spaced rods extending vertically in said frame member, a resistance means mounted in the frame member and movable along the rods, and a lifting bar mechanism. The lifting bar mechanism comprises an axle rotatably mounted in the frame member, a gear securely mounted on the axle, a lifting bar connected to the axle to rotate therewith, a clutch seat mounted on the axle surrounding and receiving the gear and having a cutout in a periphery thereof, a rocker arm extending outward from an outer periphery of the clutch seat, a first cable having a first end attached to the rocker arm and a second end attached to the resistance means, a guiding block extending outwardly from each of two edges of the cutout, a pawl member slidably guided between the guiding blocks and having a first pawl end for releasably engaging with the gear and a second end, a connecting member having a first end connected to the second end of the pawl member and a second end, an actuating member having a first end pivotally connected to the second end of the connecting member and a second end pivoted to the rocker arm, a substantially L-shaped cable block secured to the rocker arm, a clutch lever and a second cable with a first end attached to the actuating member and a second end attached to the rocker arm, and a spring provided between the L-shaped cable block and the actuating member.

Furthermore, a stop member may be provided to stop the rocker arm such that the rocker arm does not move beyond a lowermost position. By such an arrangement, the lifting bar will be in its lowermost position without hurting people even when the user does not have sufficient strength to slowly put down the lifting bar and the lowermost position of the lifting bar may be changed under operation of the clutch lever and a shifting of the lifting bar.

The exerciser may include a foldable mat with a first end pivoted to a lower section of the mount frame and a second end to which two foldable legs are mounted.

For hand exercise, the exerciser may have a bracket extending laterally and outwardly from each side of the frame member, a pulley provided to a distal end of each bracket, a corresponding cable which has a first hook end attached to a hand grip and a second end attached to the resistance means and passes through a pulley in the bracket and other pulleys in the frame member.

For leg exercise, a further pulley is provided at a lower section of both sides of the frame member and a connecting cable is provided to connect each hook end of the cable to a leg hook to allow the user to proceed with leg exercise. Preferably, a peg is provided to each side of the frame member to place the connecting cables when not in use.

For horizontal bar exercise, the exerciser may have a horizontal bar mounted on top side of the frame member at an end thereof. Preferably, two positioning protrusions are provided on the top side of the frame member to guide and restrain the horizontal bar.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
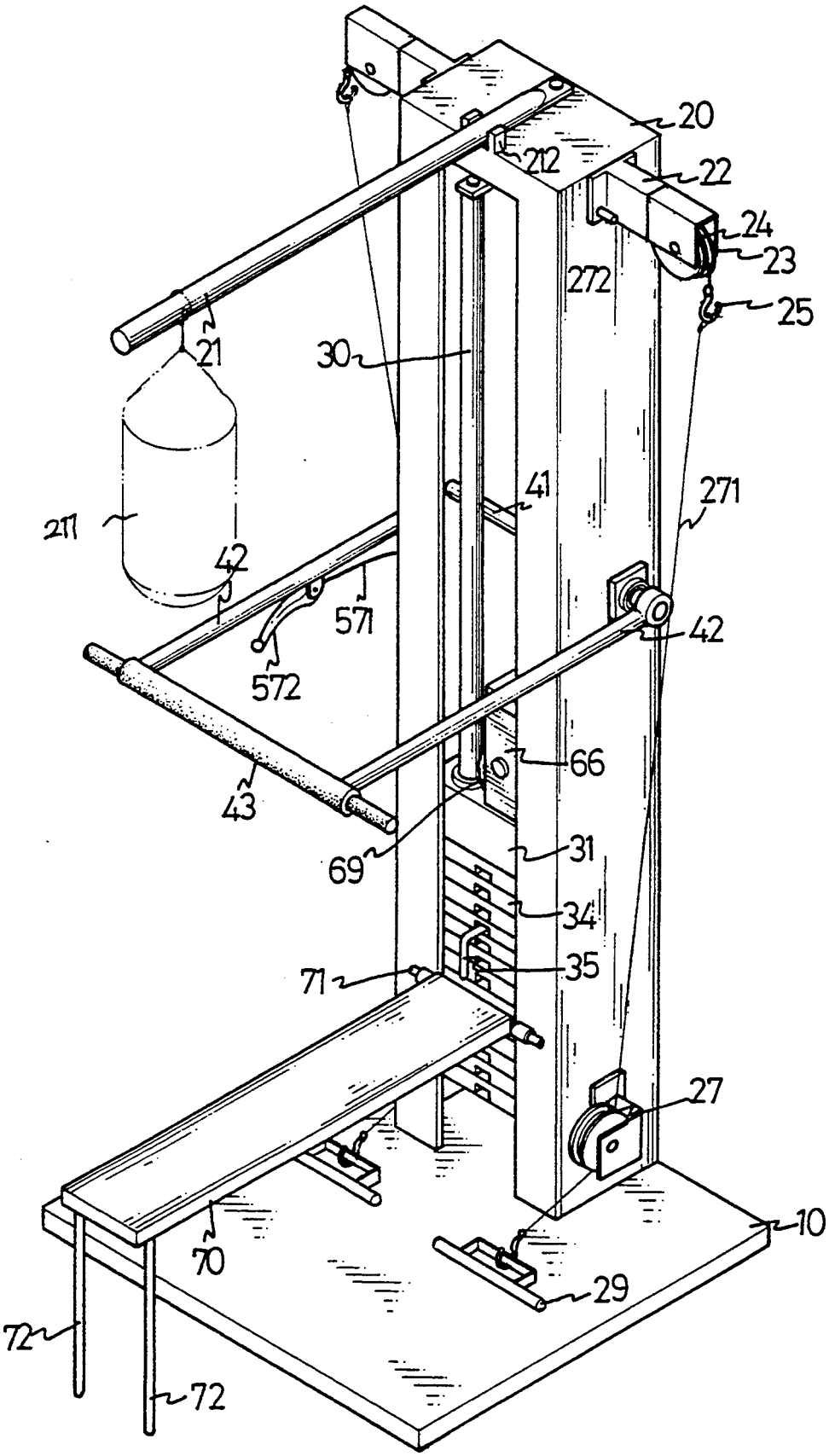
FIG. 1 is a perspective view of a multi-purpose exerciser in accordance with the present invention.

Referring to the drawings and initially to FIG. 1, a multi-purpose exerciser in accordance with the present invention generally includes a substantially rectangular weighted base 10 on which a substantially inverted U-shaped frame member 20 is mounted. A horizontal bar 21 is mounted on the top side of the frame 20 at an end thereof such that the user may practice pull up or other horizontal bar skills on it. Additionally, a sandbag 211 may be provided on the horizontal bar 21 to allow the user to practice boxing or kicking. As shown in FIG. 1, two positioning protrusions 212 are provided on the top side of the frame member 20 to guide and restrain the horizontal bar 21, preventing the user from being injured by accident.

Figure 3:
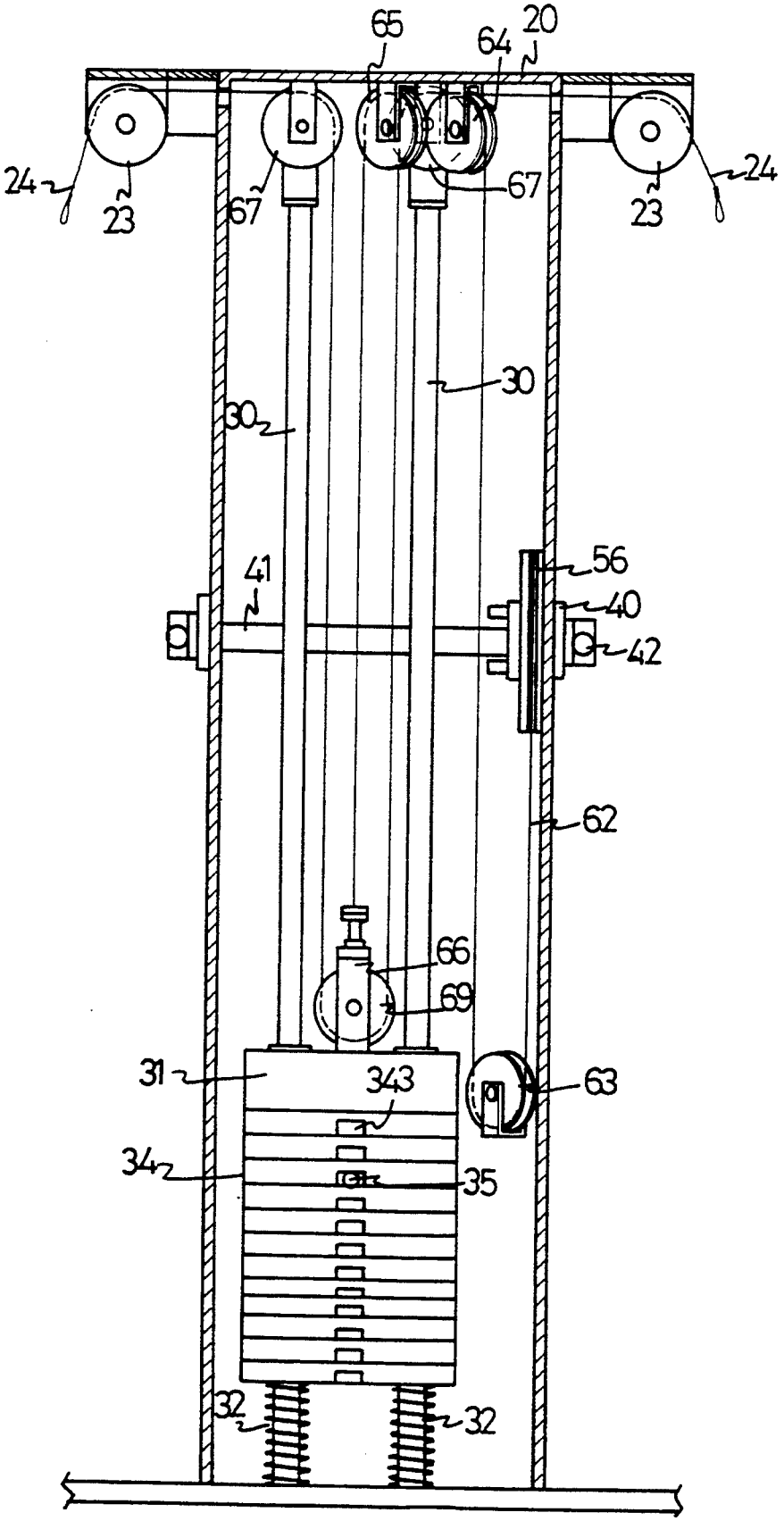
FIG. 3 is a cross-sectional view of the exerciser.
Figure 4:
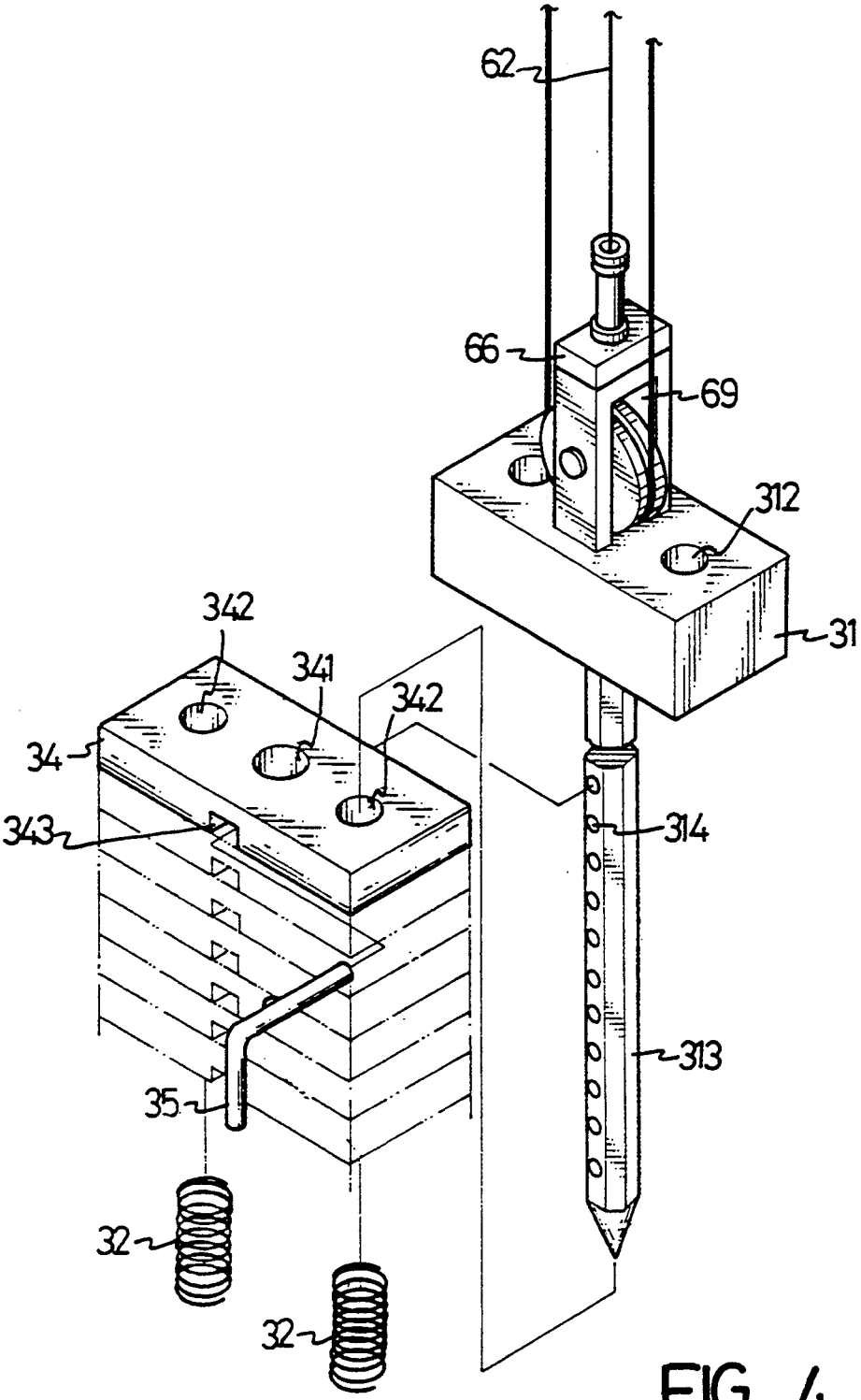
FIG. 4 is an exploded view illustrating the resistance means of the exerciser.

Referring to FIGS. 1, 3, and 4, the exerciser further includes two spaced rods 30 extending vertically in the frame member 20. Mounted to a lower end of each vertical rod 30 is a damping member, such as a spring 32, above which a resistance means consisting of a plurality of weights 34 is mounted. A mount 31 is mounted above the weights 34 and has two through holes 312 through which the vertical rods 30 pass. A pulley seat 66 is provided on the top side of the mount 31 to mount a pulley 69 therein. An insert rod 313 extends downward from an underside of the mount 31 and has a plurality of vertically spaced holes 314 therein. Each weight 34 has three through holes, a central one 341 through which the insert rod 313 passes and two side ones 342 through which the vertical rods 30 pass. An insert hole 343 is formed in a middle of each weight 34 through which a pin 35 is inserted to engage with one of the associated aligned holes 314 in the insert rod 313, by which the user may decide how many weights 34 are to be lifted.

Figure 2:
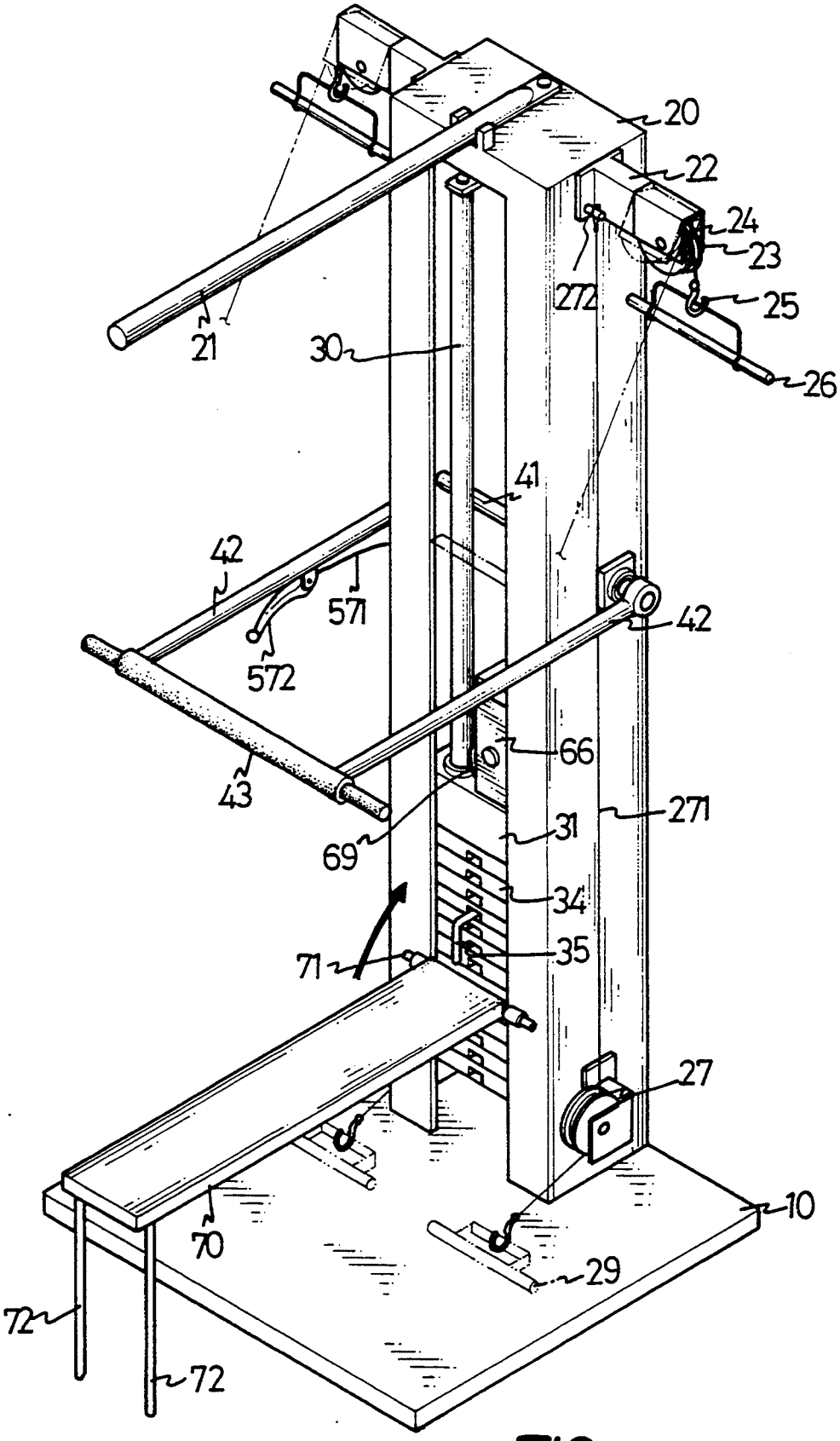
FIG. 2 is a perspective view of the multi-purpose exerciser used for different exercise.

Referring to FIGS. 1 through 3, a second pulley 67 is mounted on top of each vertical rod 32. A bracket 22 extends laterally and outwardly from each side of the frame member 20. A third pulley 23 is provided to the distal end of each bracket 22. A cable 24 passes through pulleys 23, 67, 69, 67 and 23 (from right to left or vice versa), so that the user may exercise his arms by means of pulling a hand grip 26 attached to each hooked end 25 of the cable 24 (see FIG. 2). Alternatively, as shown in FIG. 1, a fourth pulley 27 may be provided at the lower section of both sides of the frame member 20 and a connecting cable 271 may be provided to connect each hooked end 25 of the cable 24 to a leg hook 29 to allow the user to proceed with leg exercise. When not in use, the cables 271 may be respectively hung on an associated peg 272 provided to an upper section of each side of the frame member 20, as shown in FIG. 2.

Referring to FIGS. 1, 3, 5, 6, and 7, the exerciser further includes a lifting bar mechanism to provide lifting exercise. The lifting bar mechanism includes a bearing 40 mounted in a mediate section of each side of the frame member 20 to rotatably receive an axle 41 therebetween. A lifting bar 43 is connected to two ends of the axle 41 by a pair of connecting rods 42 at two ends thereof, such that the axle 41 pivots together with the lifting bar 43 when the latter is being urged by the user.

The lifting mechanism further includes a gear 52 securely mounted on the axle 41 by inserting a key 522 into a keyway 411 in the axle 41. A clutch seat 50 is mounted on the axle 41 around the gear 52 to receive the latter. A cover 53 is securely mounted to an open side of the clutch seat 50 to enclose the gear 52. Springs 54 are provided to bias the gear 52 and the biasing forces of the springs 54 are adjustable by the adjusting screws 541.

A rocker arm 56 extends outward from an outer periphery of the clutch seat 50. A cutout 501 is formed in the periphery of the clutch seat 50 and a guiding block 55 extends outwardly from each of two edges of the cutout 501. A pawl member 70 is slidably guided between the guiding blocks 55 and has a first pawl end for releasably engaging with the gear 52 and a second end secured to a first end of a connecting member 72 whose second end is pivoted to a first end of an actuating member 74, whose second end being pivoted to the rocker arm 56. A substantially L-shaped cable block 76 is secured to the rocker arm 56 and has a hole (not labeled) through which a cable 571 passes and is thus attached to an ear 80 on the actuating member 74. A spring 78 is provided between the L-shaped member 76 and the actuating member 74.

Figure 9:
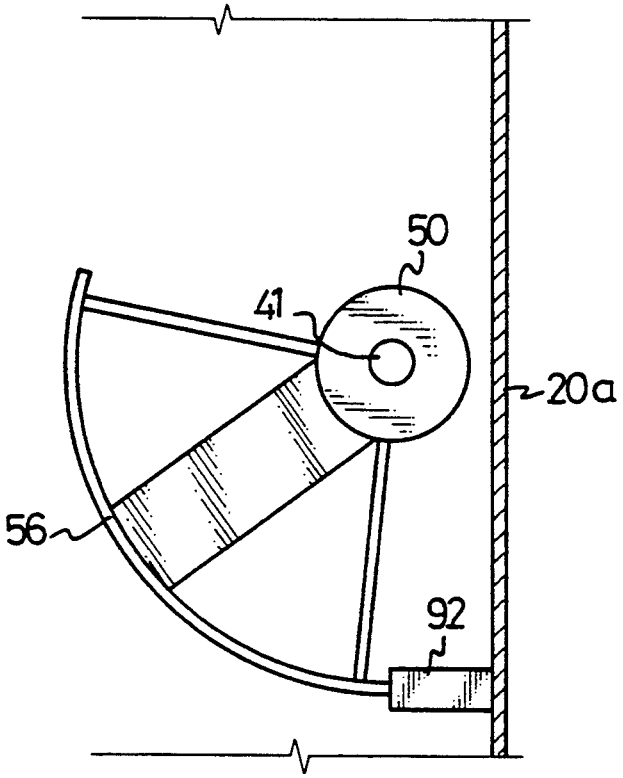
FIG. 9 is a schematic view illustrating a stop member for ensuring that the lifting bar does not move beyond a lowermost position.

Referring to FIG. 9, preferably, a stop member 92 is mounted to a rear side **20*a* of the frame member 20 to stop the rocker arm 56, such that the rocker arm 56, and thus the lifting bar 43 does not move beyond a lowermost position. By such an arrangement, the lifting bar 43 is retained in a certain position when the pawl member 70 engages with the gear 52. When the user wishes to adjust the lowermost position of the lifting bar 43, he may press a clutch lever 572 mounted on one of the connecting rods 42 and thus urge the actuating member 74 to pivot about its pivoted end via the clutch cable 571, thereby pivoting and thus pulling the connecting member 72 to pull the pawl member 70 outward and thus disengage with the gear 52 to allow the lifting bar 43 to be pivoted to change its position. Thereafter, the clutch lever 572 is released, under the action of the previously compressed spring 78, the pawl member 70 reengages with the gear 52 to securely hold the lifting bar 43 again. This arrangement has a great advantage in preventing the user from being injured. Preferably, a lining plate 51 is provided between the side surface of the gear 52 and the inner side surface of the clutch seat 50 so as to allow a slow movement of the lifting bar 43 when adjusting the lowermost position of the lifting bar 43**.

Figure 5:
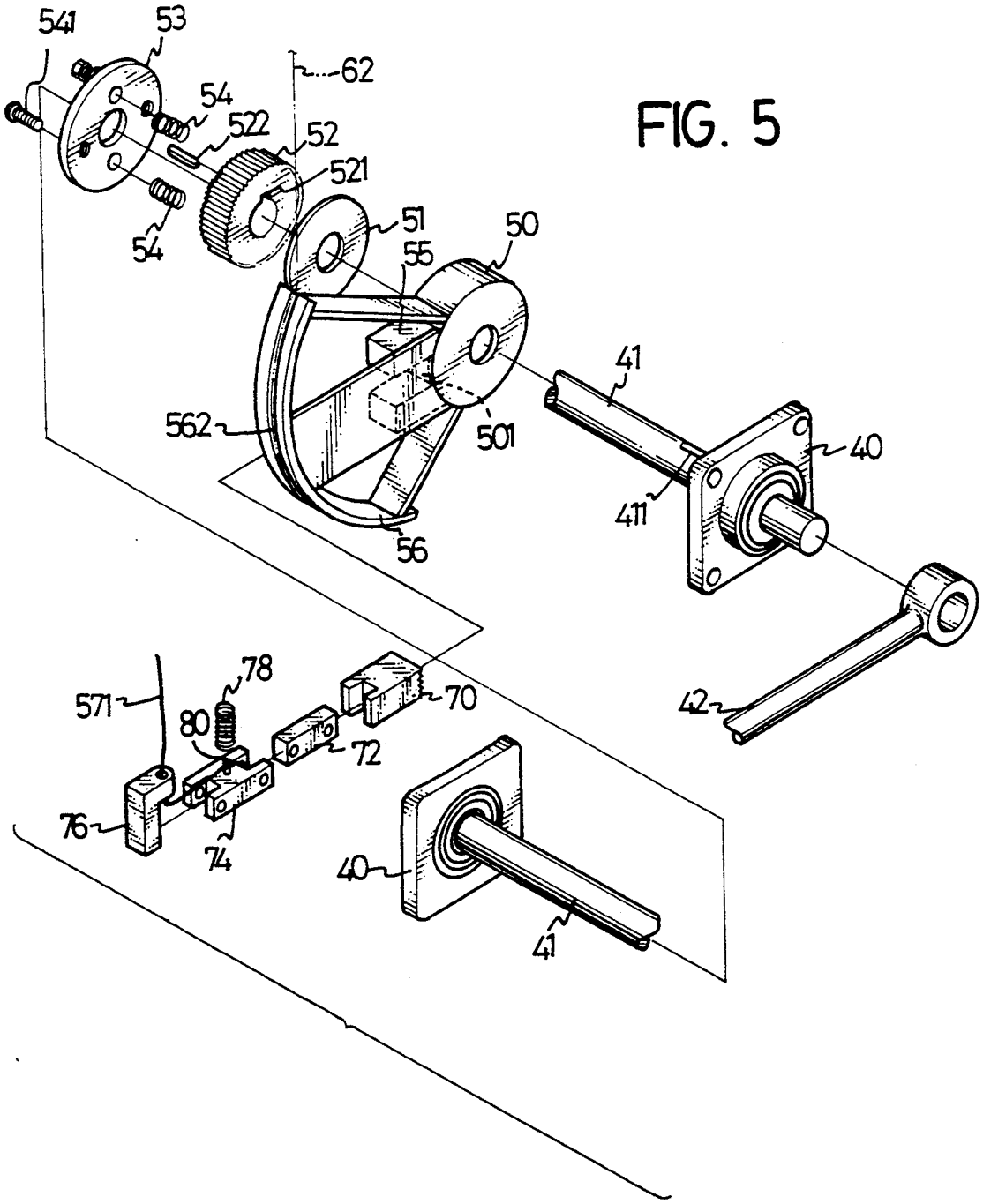
FIG. 5 is an exploded view showing detailed structure of the lifting bar mechanism of the multi-purpose exerciser.
Figure 8:
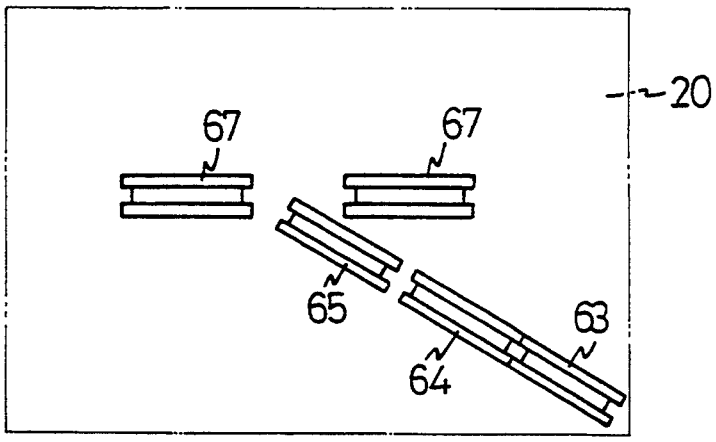
FIG. 8 is a schematic view showing the arrangement of pulleys.

As shown in FIG. 5, a groove 562 is formed in an arcuate portion of the rocker arm 56 to receive a cable 62, which has an end secured to the rocker arm 56 and passes through a pulley 63 mounted below the axle 41 and pulleys 64 and 65 mounted to an underside of the top plate of the frame member 20 and then is attached to the pulley seat 66. When the user pulls the lifting bar 43 upward, a certain amount of weights 34 are lifted via the transmission of cable 62, thereby achieving the exercising purpose.

Figure 6:
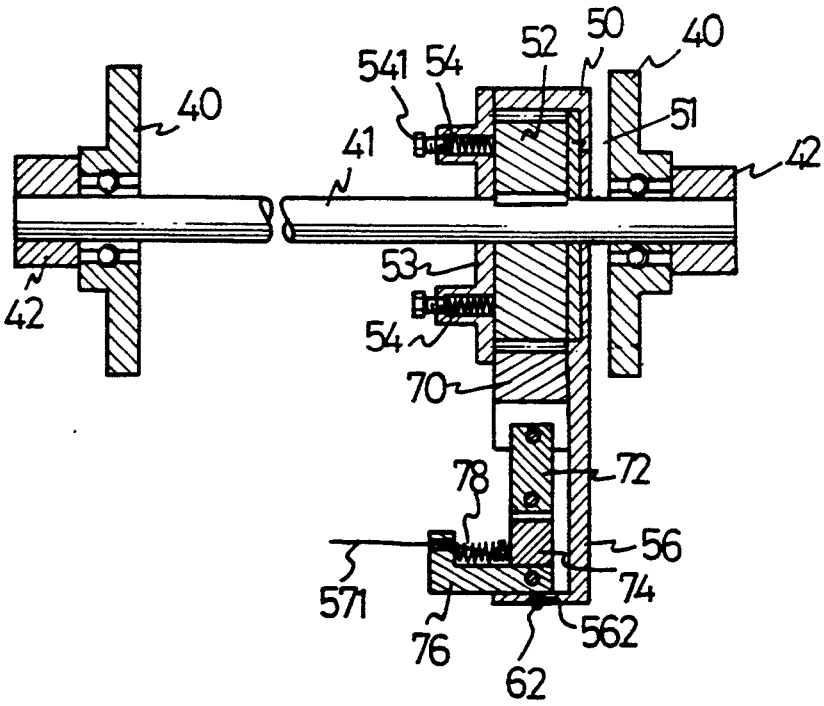
FIG. 6 is a cross-sectional view illustrating of the lifting bar mechanism in which the section line is turned through 90° to show the structure of the L-shaped member of the rocker arm.
Figure 7:
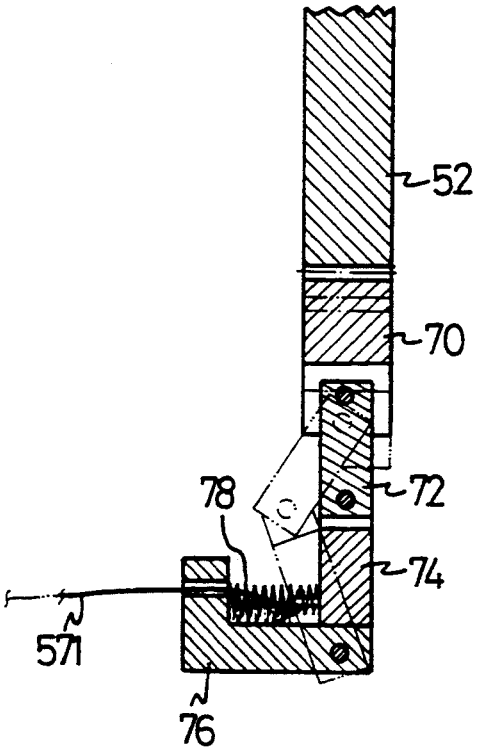
FIG. 7 is a partial cross-sectional view illustrating the clutch motion of the lifting mechanism in which the section line is turned through 90° to show the structure of the L-shaped member of the rocker arm.

Referring to FIGS. 1 and 6, the exerciser further has a foldable mat 70 with a first end pivoted by a pin 71 to a lower section of the mount frame 20 and a second end to which two foldable legs 72 are mounted. By such an arrangement, the mat 70 can be folded to avoid occupying space.

Figure 10:
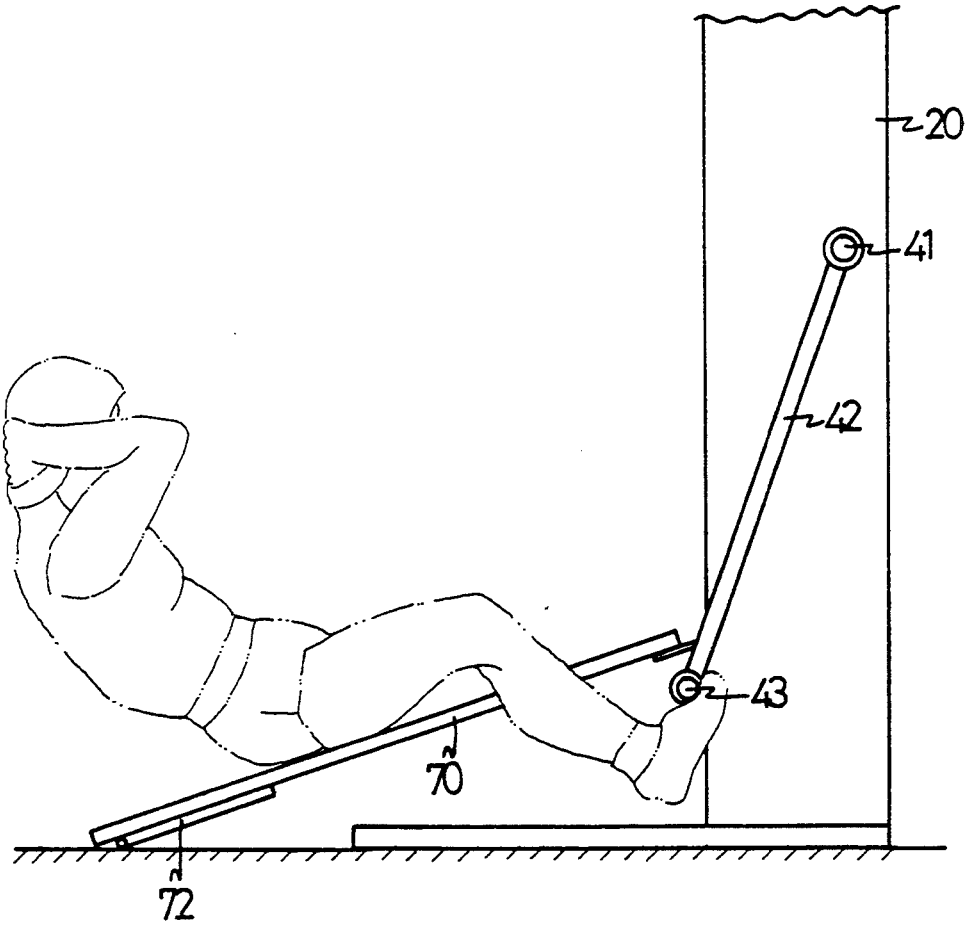
FIG. 10 is a schematic view illustrating a further use of the exerciser.

FIG. 10 shows another use of the exerciser in which the lifting bar 43 is in a very low position and the second end of the mat touches the ground, such that the user may proceed with sit up exercise.

Although the invention has been explained in relation to its preferred embodiment, it is to be understood that many other possible modifications and variations can be made without departing from the spirit and scope of the invention as hereinafter claimed.

I claim:

1. A multi-purpose exerciser comprising:

a weighted base;

a frame member mounted on said weighted base two spaced rods extending vertically in said frame member;

a resistance means mounted in said frame member and movable along said rods;

a lifting bar mechanism comprising:

an axle rotatably mounted in said frame member, a gear securely mounted on said axle;

a lifting bar connected to said axle to rotate therewith;

a clutch seat mounted on said axle surrounding and receiving said gear and having a cutout in a periphery thereof;

a rocker arm extending outward from an outer periphery of said clutch seat;

a first cable having a first end attached to said rocker arm and a second end attached to said resistance means and;

a stop member for stopping further motion of the rocker arm and the axle and thus defining a lowermost position of the lifting bar;

and a clutch means comprising:

a guiding block extending outwardly from each of two edges of said cutout;

a pawl member slidably guided between said guiding blocks and having a first pawl end for releasably engaging with said gear and a second end;

a connecting member having a first end connected to said second end of said pawl member and a second end;

an actuating member having a first end pivotally connected to said second end of said connecting member and a second end pivoted to said rocker arm;

a substantially L-shaped cable block secured to said rocker arm;

2. The exerciser as claimed in claim 1 wherein pulley means are provided in the frame member, a clutch lever and a cable with a first end attached to said actuating member and a second end attached to an controlled by said clutch lever; and a spring provided between said L-shaped cable block and said actuating member.

3. The exerciser as claimed in claim 1 further comprising a foldable mat with a first end pivoted to a lower section of said mount frame and a second end to which two foldable legs are mounted.

4. The exerciser as claimed in claim 1 wherein a bracket extends laterally and outwardly from each side of said frame member, a pulley being provided to a distal end of each said bracket, and a further cable having a first end attached to said resistance means and a second hook end to which a hand grip is removably attached.

5. The exerciser as claimed in claim 4 wherein a further pulley is provided at a lower section of both sides of said frame member and a connecting cable (271) is provided to connect each hook end of said further cable (24) to a leg hook to allow the user to proceed with leg exercise.

6. The exerciser as claimed in claim 5 wherein a peg is provided to each side of said frame member to retain said connecting cable cables when not in use.

7. The exerciser as claimed in claim 1 wherein a horizontal bar is mounted on the top side of said frame member at an end thereof.

8. The exerciser as claimed in claim 7 wherein two positioning protrusions are provided on the top side of said frame member to guide and restrain said horizontal bar.

* * * * *